US008974259B2

(12) United States Patent
Kuczynski et al.

(10) Patent No.: US 8,974,259 B2
(45) Date of Patent: Mar. 10, 2015

(54) ELECTRICAL CONNECTORS WITH ENCAPSULATED CORROSION INHIBITOR

(71) Applicant: International Business Machines Corporation, Armonk, NY (US)

(72) Inventors: Joseph Kuczynski, Rochester, MN (US); Robert E. Meyer, III, Rochester, MN (US); Mark D. Plucinski, Rochester, MN (US); Timothy J. Tofil, Rochester, MN (US); Jason T. Wertz, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 54 days.

(21) Appl. No.: 13/845,481

(22) Filed: Mar. 18, 2013

(65) Prior Publication Data

US 2014/0273614 A1 Sep. 18, 2014

(51) Int. Cl.

| | |
|---|---|
| ***H01R 13/02*** | (2006.01) |
| ***H01R 13/52*** | (2006.01) |
| ***H01R 43/20*** | (2006.01) |

(52) U.S. Cl.

CPC ..... *H01R 13/52* (2013.01); *H01R 43/20* (2013.01)

USPC ..... 439/886; 439/519

(58) Field of Classification Search

CPC ..... C08K 9/10; H01R 13/03

USPC ..... 439/886, 519

See application file for complete search history.

(56) References Cited

U.S. PATENT DOCUMENTS

| | | | | |
|---|---|---|---|---|
| 5,360,350 | A | 11/1994 | Koblitz et al. | |
| 5,941,736 | A * | 8/1999 | Murakami | 439/733.1 |
| 6,075,072 | A * | 6/2000 | Guilbert et al. | 523/200 |
| 6,080,334 | A * | 6/2000 | Heimann et al. | 252/389.62 |
| 6,383,271 | B1 * | 5/2002 | Schmidt | 106/14.41 |
| 6,716,526 | B2 * | 4/2004 | Weston et al. | 428/402.2 |
| 6,933,046 | B1 * | 8/2005 | Cook | 428/402 |
| 7,192,993 | B1 * | 3/2007 | Sarangapani et al. | 523/200 |
| 7,270,775 | B2 * | 9/2007 | Kubik et al. | 252/389.3 |
| 7,294,028 | B2 * | 11/2007 | Rehbein et al. | 439/886 |
| 7,331,820 | B2 | 2/2008 | Burris et al. | |
| 7,342,057 | B2 * | 3/2008 | Kumar et al. | 523/200 |
| 7,612,152 | B2 * | 11/2009 | Braun et al. | 525/476 |
| 7,723,405 | B2 * | 5/2010 | Braun et al. | 523/212 |
| 7,766,983 | B2 * | 8/2010 | Schaeffer et al. | 44/357 |
| 7,790,225 | B1 * | 9/2010 | Calle et al. | 427/212 |
| 7,811,666 | B2 * | 10/2010 | Dry | 428/408 |
| 8,012,374 | B2 * | 9/2011 | van Ooij et al. | 252/389.54 |
| 8,101,036 | B2 * | 1/2012 | Schroeder et al. | 156/73.1 |
| 8,323,741 | B2 * | 12/2012 | Abys et al. | 427/337 |
| 8,333,622 | B2 * | 12/2012 | Blasko et al. | 439/852 |
| 8,383,559 | B2 * | 2/2013 | Setlur et al. | 507/219 |
| 8,701,879 | B2 * | 4/2014 | Xie et al. | 206/222 |
| 8,721,959 | B2 * | 5/2014 | Dry | 264/573 |
| 8,741,390 | B2 * | 6/2014 | Abys et al. | 427/409 |
| 2002/0081431 | A1 * | 6/2002 | Schmdt | 428/402 |

(Continued)

FOREIGN PATENT DOCUMENTS

WO WO2012075293 A2 7/2012

*Primary Examiner* — Ross Gushi

(74) *Attorney, Agent, or Firm* — Robert Williams

(57) ABSTRACT

According to embodiments of the invention, an electrical connector structure with an encapsulated corrosion inhibitor may be provided. The structure may include a first electrical connector having a first contact surface. The structure may also include an encapsulated corrosion inhibitor applied to at least a portion of the first contact surface.

20 Claims, 3 Drawing Sheets

(56) References Cited

U.S. PATENT DOCUMENTS

| | | | | |
|---|---|---|---|---|
| 2002/0197468 | A1* | 12/2002 | Sinko | 428/336 |
| 2004/0069972 | A1* | 4/2004 | Kubik et al. | 252/389.3 |
| 2005/0059772 | A1* | 3/2005 | Horikoshi et al. | 524/588 |
| 2005/0176851 | A1* | 8/2005 | Cook | 523/210 |
| 2006/0091354 | A1* | 5/2006 | van Ooij et al. | 252/70 |
| 2006/0094309 | A1* | 5/2006 | Holtkamp et al. | 439/886 |
| 2006/0105641 | A1* | 5/2006 | Rehbein et al. | 439/886 |
| 2009/0078153 | A1* | 3/2009 | Shchukin et al. | 106/14.44 |
| 2009/0121192 | A1* | 5/2009 | Abys et al. | 252/392 |
| 2009/0306241 | A1* | 12/2009 | Allard et al. | 522/83 |
| 2010/0242788 | A1* | 9/2010 | Calle et al. | 106/14.11 |
| 2010/0305234 | A1* | 12/2010 | Calle et al. | 523/205 |
| 2011/0062036 | A1* | 3/2011 | Xie et al. | 206/222 |
| 2011/0064941 | A1* | 3/2011 | Sachdev et al. | 428/327 |
| 2013/0017612 | A1* | 1/2013 | Li et al. | 436/75 |
| 2013/0145957 | A1* | 6/2013 | Shchukin et al. | 106/14.05 |
| 2013/0196071 | A1* | 8/2013 | Yang et al. | 427/386 |
| 2013/0210969 | A1* | 8/2013 | Grigoriev et al. | 524/92 |
| 2013/0280910 | A1* | 10/2013 | Ihnfeldt, Robin | 438/693 |

* cited by examiner

ELECTRICAL CONNECTORS WITH ENCAPSULATED CORROSION INHIBITOR

TECHNICAL FIELD

The field of the invention relates generally to electronic components, and more specifically, to a heat sink a fan structure for providing cooling to electronic components.

BACKGROUND

Computer systems typically include a combination of computer programs and hardware, such as semiconductors, transistors, chips, circuit boards, storage devices, and processors. The computer programs are stored in the storage devices and are executed by the processors. A common feature of many computer systems may be the presence of one or more circuit boards. Circuit boards may contain a variety of electronic components mounted to them. It may also be common for one or more of the electronic components to be electrically connected to a circuit board and to each other by one or more electrical connectors.

SUMMARY

According to embodiments of the invention, an electrical connector structure with an encapsulated corrosion inhibitor may be provided. The structure may include a first electrical connector having a first contact surface. The structure may also include an encapsulated corrosion inhibitor applied to at least a portion of the first contact surface.

According to other embodiments, the structure may include a first electrical connector having a first electrical connector body and a plurality of electrically conductive pins, wherein at least a portion of the surface of the pins comprise a first electrically conductive contact surface. The structure may also include a second electrical connector having a second electrical connector body and a plurality of receptacles containing one or more electrically conductive contacts, wherein the electrically conductive contacts comprise a second electrically conductive contact surface and the receptacles are adapted to receive the pins in a coupled position, and the second contact surface is adapted to contact the first contact surface. The structure may also include an encapsulated corrosion inhibitor applied to at least a portion of the first contact surface, wherein at least a portion of the encapsulated corrosion inhibitor is adapted to rupture and release the corrosion inhibitor when the first electrical connector and the second electrical connector are coupled.

According to other embodiments, a method for providing an electrical connector structure with an encapsulated corrosion inhibitor may be provided. The method may include providing a first electrical connector having a first contact surface. The method may also include providing an encapsulated corrosion inhibitor applied to at least a portion of the first contact surface.

BRIEF DESCRIPTION OF THE SEVERAL VIEWS OF THE DRAWINGS

In the drawings and the Detailed Description, like numbers generally refer to like components, parts, steps, and processes.

DETAILED DESCRIPTION

Many modern day electronic components may operate in environments where corrosive contaminants, such as chlorine and sulfides, are present. These contaminants may pose a threat to the electrical connectors of those electronic components. The functional lifespan of those electrical connectors may be significantly diminished when corrosive contaminants are allowed to come in contact with them, which may affect the functionality of the electronic components associated with those electrical connectors. In order to reduce the damage that may be caused by corrosive contaminants, a corrosion inhibitor may be applied to one or more of the contact surfaces of the electrical contacts. A corrosion inhibitor may be any substance which inhibits corrosion. Examples of corrosion inhibitors are the Cor-Ban® products from the Zip-Chem® Company of Morgan Hill, Calif.

However, since corrosion inhibitors may often be liquids, their presence may serve to collect contamination from the time the inhibitor has been applied to the contact surface to the time it may be installed. For example, a computer system may have a component which has failed and needs to be replaced. The owner of the computer system orders a replacement from the manufacturer of the component. Part of the manufacturing process of the replacement component may be to apply a corrosion inhibitor to the electrical connectors that will connect the replacement component to the computer system. Between the time at which the corrosion inhibitor may be applied and the replacement component's installation in the computer system, the component may be subject to contamination inherent in the shipping and handling of the component. It may be desirable for the corrosion inhibitor not to attract contamination during that time as the contamination may affect the functionality or the lifespan of the replacement component after it is installed in the computer system.

Embodiments of the invention provide an electrical connector with an electrical contact surface and an encapsulated corrosion inhibitor applied to a portion of the contact surface. A capsule may be a small or microscopic capsule adapted to release its contents when ruptured. By encapsulating the corrosion inhibitor it may be protected from exposure to contamination. Upon installation of the electrical connector, the proximity of the contact surfaces of the electrical connector and its mating connector may rupture the capsules and release the corrosion inhibitor. Upon rupture and release of the corrosion inhibitor from the capsules, it may be free to flow around the contact area of the electrical connectors in order to create a barrier to contaminants.

Figure 1A:
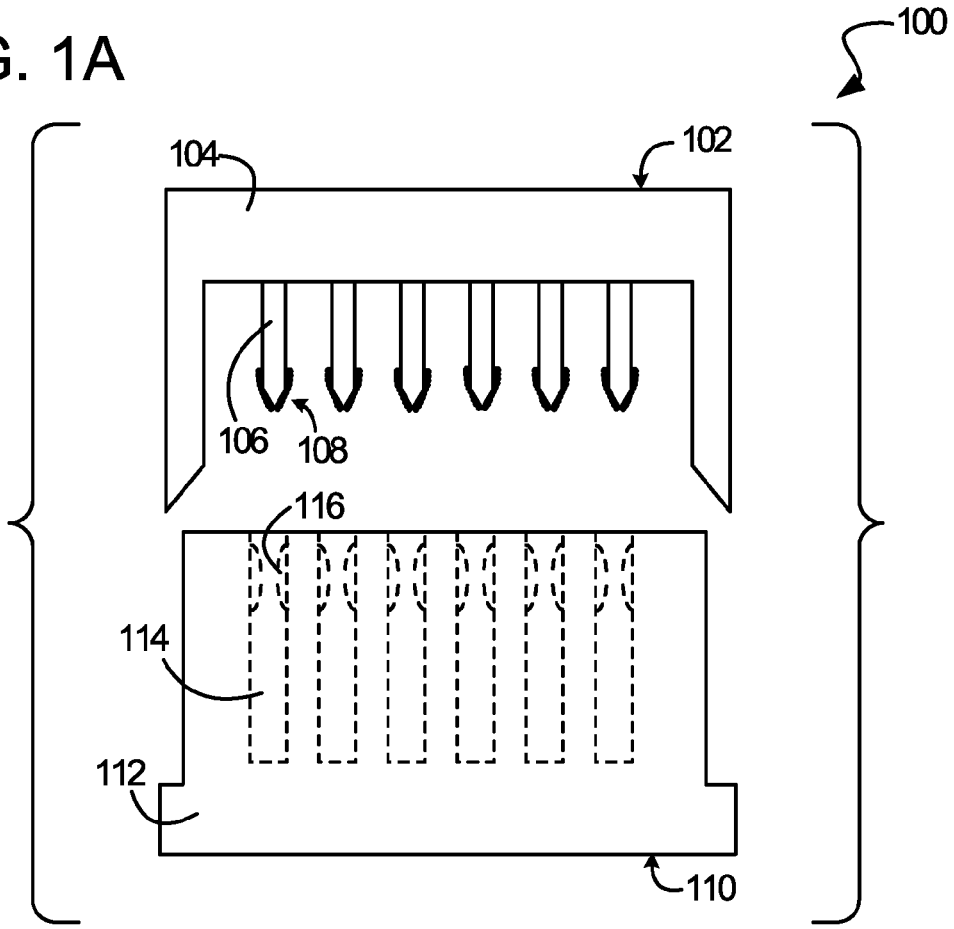
FIG. 1A is a side view of an assembly in an exploded position, according to an embodiment of the invention.

Referring to the drawings, wherein like numbers denote like parts throughout the several views, FIG. 1A is a side view of the assembly 100 in an exploded position, according to an embodiment of the invention. The assembly 100 may include a first electrical connector 102. The first electrical connector 102 of FIG. 1A is depicted as a male connector but in other embodiments the first electrical 102 connector may be a female connector. The first electrical connector 102 may be part of a larger assembly (not depicted), such as a circuit board, a wiring assembly, or any similar electronic component. The first electrical connector 102 may include an electrical connector body 104 and any number of electrical contact surfaces such as electrically conductive pins 106. The pins 106 may have a surface which includes a thin layer of metal alloy. The metal alloy may contain any electrically conductive metal such as gold, silver, platinum, palladium, iridium, rhodium, or any other similar metal. An encapsulated corrosion inhibitor 108 may be applied to the surface of pins 106. As previously stated, a corrosion inhibitor may be any substance which inhibits corrosion and a capsule may be a small or microscopic capsule adapted to release its contents when ruptured. In various embodiments, the encapsulated corrosion inhibitor may be a micro-encapsulated corrosion inhibitor in which the micro-capsules have a diameter of 2 to 2000 μm. Also in various embodiments, the outer shell of a capsule may be made from a variety of compounds such as urea formaldehyde.

In some embodiments, the encapsulated corrosion inhibitor 108 may be applied to the surface of the pins 106 as part of a solution. The encapsulated corrosion inhibitor 108 may be considered the solute of the solution. The solvent may include any liquid capable of holding the encapsulated corrosion inhibitor 108 in a state of liquid suspension, such as isopropyl alcohol or a ketone such as acetone or methyl ethyl ketone. This solution may be applied as an aerosol, a thin liquid film, or any other suitable forms of application. In some embodiments, the solvent may evaporate after the solution is applied and thereby leaving only the encapsulated corrosion inhibitor 108.

In some embodiments, the capsule may be adapted to bond to a metal contained in an electrical contact surface. For example, if the contact surface includes gold, then the capsule may be adapted to bond to the gold thereby providing an improved adherence of the capsules to the contact surface. In some embodiments, this bonding may be accomplished by incorporating a mercaptan into the shell of the capsule. For example, an allyl mercaptan may be entangled in a urea formaldehyde capsule shell in order to functionally bind the mercaptan. A detailed prophetic description of the procedure of preparing above described capsule is listed below.

The assembly 100 may also include a second electrical connector 110. The second electrical connector 110 may be a mate to the first electrical connector 102. For example, if the first electrical connector 102 is a male connector, the second electrical connector 110 may be a female connector and vice versa. The second electrical connector 110 may also be part of a larger assembly (not depicted), such as a circuit board, a wiring assembly, or any similar electronic component. The second electrical connector 110 may include an electrical connector body 112 and receptacles 114 for receiving the pins 106. Each receptacle 114 may include one or more electrical contact surfaces such as electrically conductive tabs 116. The tabs 116 may also have a surface which includes a thin layer of metal alloy. As previously stated, the metal alloy may contain any electrically conductive metal such as gold, silver, platinum, palladium, iridium, rhodium, or any other similar metal. In other embodiments, the encapsulated corrosion inhibitor 108 may be applied to both the surface of the pins 106 and the surfaces of the tabs 116, or it may be applied to just the surface of the tabs 116.

Figure 1B:
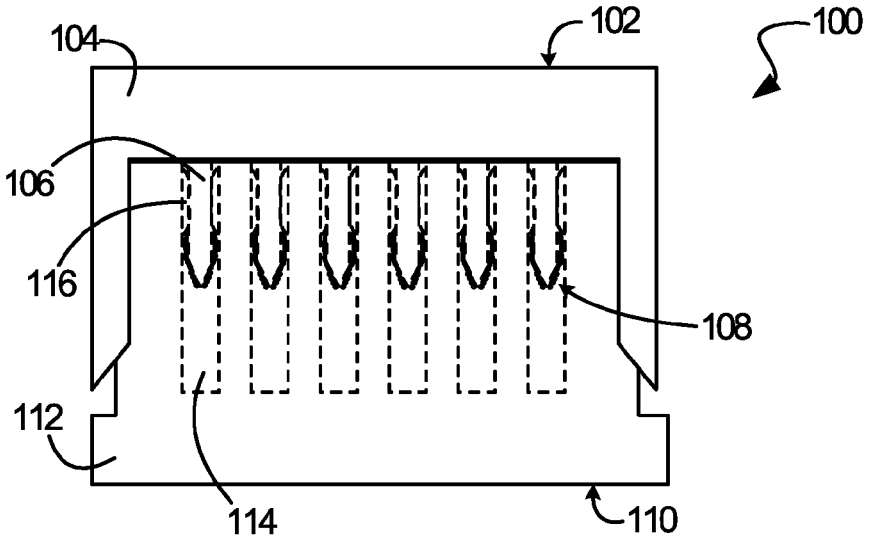
FIG. 1B is a side view of the assembly of FIG. 1A in an assembled position, according to an embodiment of the invention.

FIG. 1B is a side view of the assembly 100 in an assembled position, according to an embodiment of the invention. In the assembled position, the first electrical connector 102 may be coupled with the second electrical connector 110. In the coupled position, the pins 106 may be located within the receptacles 114. Also in the coupled position, the pins 106 may be in electrical contact with the tabs 116. As the electrical connectors 102 and 110 are coupled and the pins 106 enter the receptacles 114, the proximity of the pins 106 to the tabs 116 may result in the rupture of some of the encapsulated corrosion inhibitor 108. The ruptured capsules may then release the corrosion inhibitor which may then be allowed to flow around the contact area of the pins 106 and the tabs 116.

Figure 2B:
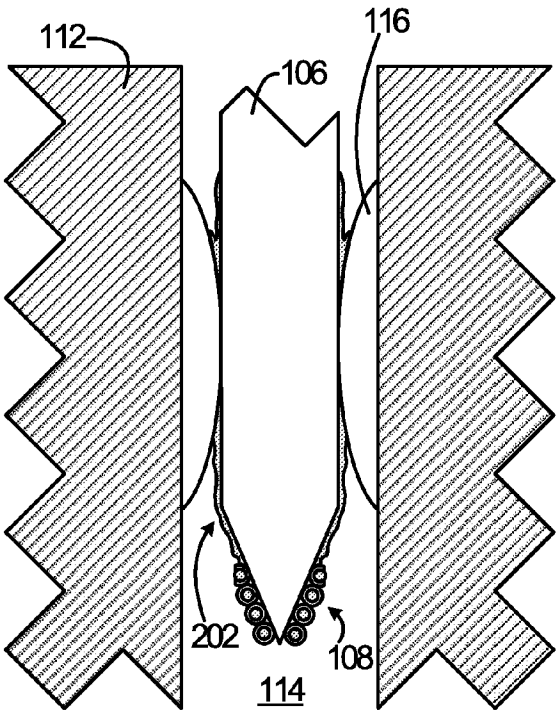
FIG. 2B is a zoomed view of an area of FIG. 1B with a partial cross-section, according to an embodiment of the invention.
Figure 2A:
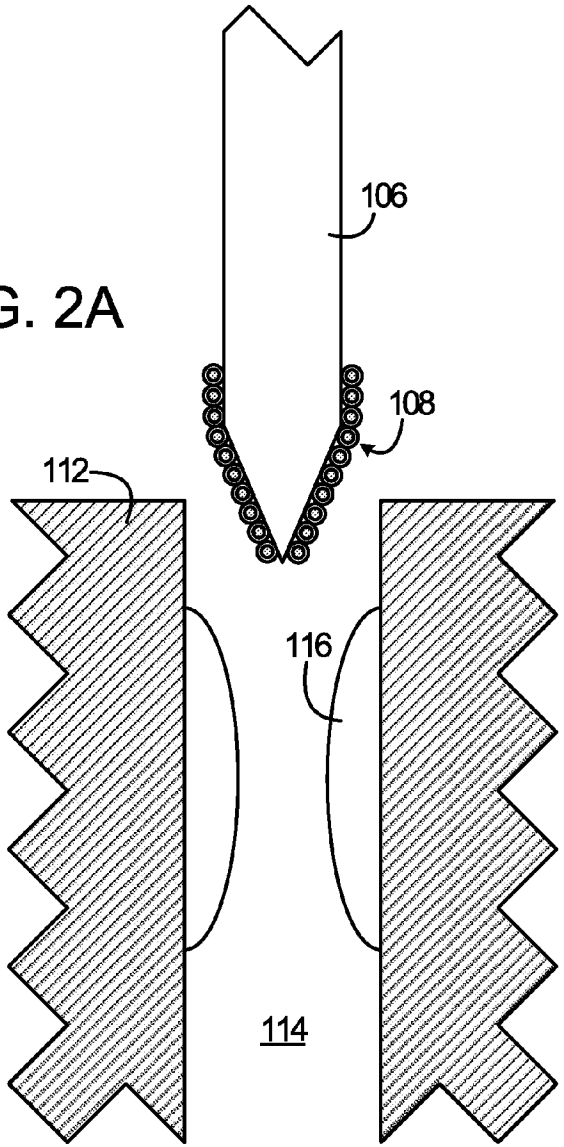
FIG. 2A is a zoomed view of an area of FIG. 1A with a partial cross-section, according to an embodiment of the invention.

FIG. 2A is a zoomed view of an area of FIG. 1A with a partial cross-section, according to an embodiment of the invention. This view shows in greater detail one of the pins 106 with the encapsulated corrosion inhibitor 108 applied to it. The view also shows the receptacle 114 within the connector body 112 which corresponds to the pin 106. The receptacle 114 may contain the tabs 116 which may be intended to make electrical contact with the pin 106 in a coupled position.

FIG. 2B is a zoomed view of an area of FIG. 1B with a partial cross-section, according to an embodiment of the invention. This view shows in greater detail one of the pins 106 after it has entered the receptacle 114. As previously stated, in this coupled position, the pin 106 may be in electrical contact with the tabs 116. Also as previously stated, as the pins 106 enter the receptacles 114, the proximity of the pins 106 to the tabs 116 may result in the rupture of some of the encapsulated corrosion inhibitor 108. The ruptured capsules may then release the corrosion inhibitor which may then be allowed to flow around the contact area of the pins 106 and the tabs 116.

Figure 3:
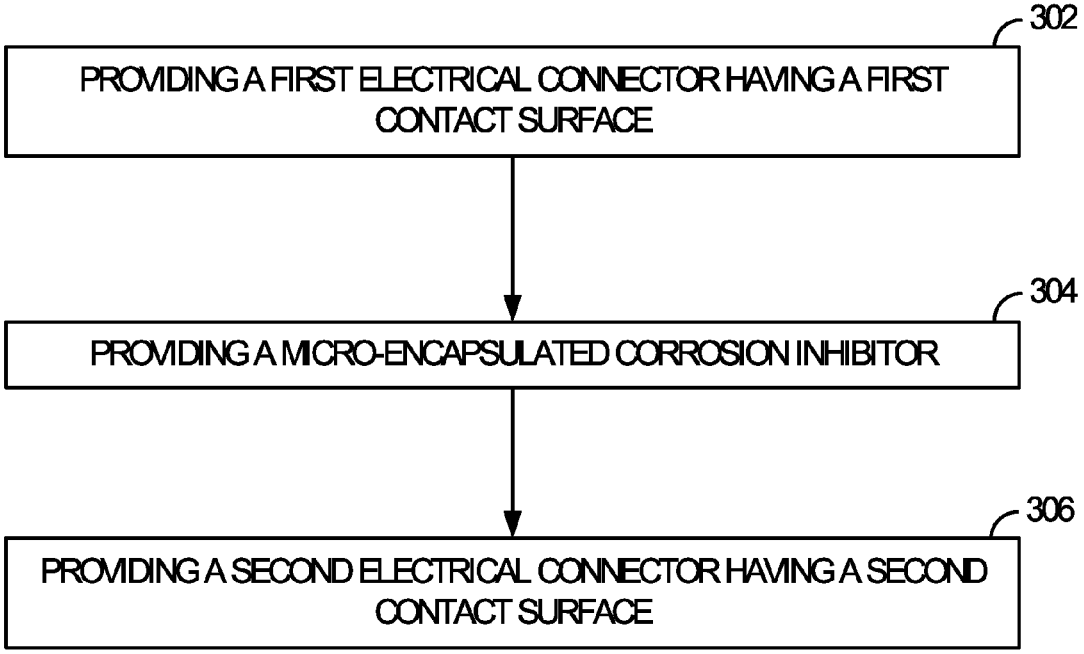
FIG. 3 is a flow chart of a method of creating an electrical connector structure with an encapsulated corrosion inhibitor, according to an embodiment of the invention.

FIG. 3 is a flow chart of a method of creating an electrical connector structure with an encapsulated corrosion inhibitor, according to an embodiment of the invention. Block 302 may contain the operation of providing a first electrical connector having a first contact surface. Examples of electrical connectors are electrical connectors 102 and 110 depicted in FIGS. 1A and 1B. The Block 304 may contain the operation of providing an encapsulated corrosion inhibitor applied to at least a portion of the first contact surface. As previously stated, the encapsulated corrosion inhibitor may be part of a solution and it may be adapted to bond to a particular metal used in the first contact surface.

Block 306 may contain the operation of providing a second electrical connector having a second contact surface. The second electrical connector may be the mating connector to the first electrical connector and therefore may be adapted to couple with the first electrical connector. Also, the second contact surface may be adapted to contact the first contact surface. This contact may allow electrical communication between the first electrical connector and the second electrical connector. At least a portion of the encapsulated corrosion inhibitor may be adapted to rupture and release the corrosion inhibitor due to the proximity of the second contact surface to the first contact surface. This rupture may occur as the first electrical connector is coupled with the second electrical connector. As previously stated, the ruptured capsules may then release the corrosion inhibitor which may then be allowed to flow around the areas where the first contact surface contacts the second contact surface. Alternatively, the encapsulated corrosion inhibitor may be applied to both the first and second contact surface, or it may be applied to only the second contact surface.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Experimental Protocols

The following illustrative experimental protocols are prophetic examples which may be practiced in a laboratory environment.

Formation of Orthogonally Functional Resorcinol, Mercaptan Chloride

Solution A contains phloroglucinol and water. Solution B contains mercaptan chloride, triethyl amine, and tetrahydrofuran (THF). Solution B is added to solution A and kept in a cold bath at 0° C.

Formation of Orthogonally Functional Resorcinol, 3-Chloro-1-Propanethiol

Solution A contains phloroglucinol, KOH, and water. Solution B contains 3-Chloro-1-propanethiol, and DMSO. Solution B is added to Solution A and kept at 50 C for 1-8 hrs.

Preparation of Mercaptan-Functionalized Capsules

Capsules were prepared by in situ polymerization in an oil-in-water emulsion. At room temperature (20-24° C.), 200 ml of deionized water and 50 ml of 2.5 wt % aqueous solution of EMA copolymer were mixed in a 1000 ml beaker. The beaker was suspended in a temperature-controlled water bath on a programmable hotplate with external temperature probe (Dataplate® Digital Hotplate, Cole-Palmer®). The solution was agitated with a digital mixer (Eurostar®, IKA®) driving a three-bladed, 63.5 mm diameter low-shear mixing propeller (Cole-Parmer®) placed just above the bottom of the beaker. Under agitation, 5.00 g urea, 0.50 g ammonium chloride and 0.50 g mercaptan functionalized resorcinol were dissolved in the solution. The pH was raised from 2.60 to 3.50 by dropwise addition of sodium hydroxide (NaOH) and hydrochloric acid (HCl). One to two drops of 1-octanol were added to eliminate surface bubbles. A slow stream of 60 ml of ZipChem® was added to form an emulsion and allowed to stabilize for 10 min. After stabilization, 12.67 g of 37 wt % aqueous solution of formaldehyde was added to obtain a 1:1.9 molar ratio of formaldehyde to urea (SANGHVI, S. P. and NAIRN, J. G., 1992, Effect of viscosity and interfacial-tension on particle-size of cellulose acetate trimellitate microspheres. Journal of Microencapsulation, 9, 215-227.). The emulsion was covered and heated at a rate of 1° C./min to the target temperature of 55° C. After 4 h of continuous agitation the mixer and hot plate were switched off. Once cooled to ambient temperature, the suspension of capsules was separated under vacuum with a coarse-fritted filter. The capsules were rinsed with deionized water and air dried for 24-48 h. A sieve was used to aid in separation of the capsules.

What is claimed is:

1. An assembly comprising:

a first electrical connector having metal forming a first contact surface; and a plurality of microscopic capsules encapsulating a corrosion inhibitor and each microscopic capsule of the plurality microscopic capsules having a capsule shell that is chemically bonded to the metal of at least a portion of the first contact surface.

2. The assembly of claim 1, further comprising a second electrical connector having a second contact surface, wherein the second electrical connector is adapted to couple with the first electrical connector and the second contact surface is adapted to contact the first contact surface, and at least some of the plurality of microscopic capsules are adapted to rupture and release the encapsulated corrosion inhibitor when the first electrical connector and the second electrical connector are coupled.

3. The assembly of claim 2, wherein the plurality of microscopic capsules is applied to at least a portion of the second contact surface.

4. The assembly of claim 1, wherein the first contact surface includes a coating of a metal alloy containing at least one of gold, silver, platinum, palladium, iridium, rhodium, and tin.

5. The assembly of claim 1, wherein the plurality of microscopic capsule shells includes a sulfur-containing compound selected from the group consisting of a mercaptan and a propanethiol.

6. The assembly of claim 1, wherein the encapsulated corrosion inhibitor is a solute of a solution.

7. The assembly of claim 6, wherein a solvent of the solution is adapted to evaporate after the solution has been applied to the first contact surface.

8. An assembly comprising:

a first electrical connector having a first electrical connector body and a plurality of electrically conductive pins, wherein at least a portion of the surface of the pins comprise a first electrically conductive contact surface;

a second electrical connector having a second electrical connector body and a plurality of receptacles containing one or more electrically conductive contacts, wherein the electrically conductive contacts comprise a second electrically conductive contact surface and the receptacles are adapted to receive the pins in a coupled position, and the second contact surface is adapted to contact the first contact surface; and a plurality of microscopic capsules encapsulating a corrosion inhibitor and each microscopic capsule of the plurality of microscopic capsules having a capsule shell that is chemically bonded to at least a portion of the first contact surface, wherein each microscopic capsule of the plurality of microscopic capsules is adapted to rupture and release the corrosion inhibitor when the first electrical connector and the second electrical connector are coupled.

9. The assembly of claim 8, further comprising a second plurality of microscopic capsules each having a shell that is chemically bonded to at least a portion of the second contact surface.

10. The assembly of claim 8, wherein the first contact surface includes a coating of a metal alloy containing at least one of gold, silver, platinum, palladium, iridium, rhodium, and tin.

11. The assembly of claim 8, wherein the plurality of microscopic capsules includes a sulfur-containing compound selected from the group consisting of a mercaptan and a propanethiol.

12. The assembly of claim 8, wherein the encapsulated corrosion inhibitor is a solute of a solution.

13. The assembly of claim 12, wherein a solvent of the solution is adapted to evaporate after the solution has been applied to the first contact surface.

14. A method comprising:

providing a first electrical connector having metal forming a first contact surface; and providing a plurality of microscopic capsules encapsulating a corrosion inhibitor and each microscopic capsule of the plurality of microscopic capsules having a capsule shell that is chemically bonded to the metal of at least a portion of the first contact surface.

15. The method of claim 14, further comprising providing a second electrical connector having a second contact surface, wherein the second electrical connector is adapted to couple with the first electrical connector and the second contact surface is adapted to contact the first contact surface, and at least a portion of the plurality of microscopic capsules encapsulating the corrosion inhibitor are adapted to rupture and release the corrosion inhibitor when the first electrical connector and the second electrical connector are coupled.

16. The method of claim 15, wherein a second plurality of microscopic capsules is chemically bonded to at least a portion of the second contact surface.

17. The method of claim 14, wherein the first contact surface includes a coating of a metal alloy containing at least one of gold, silver, platinum, palladium, iridium, rhodium, and tin.

18. The method of claim 14, wherein the plurality of microscopic capsules each contain a sulfur-containing compound selected from the group consisting of a mercaptan and a propanethiol.

19. The method of claim 14, wherein the encapsulated corrosion inhibitor is a solute of a solution.

20. The method of claim 19, wherein a solvent of the solution is adapted to evaporate after the solution has been applied to the first contact surface.

* * * * *